US005632431A

United States Patent [19]

Lin

[11] Patent Number: 5,632,431

[45] Date of Patent: May 27, 1997

[54] NAIL MAGAZINE OF NAIL STAPLER

[76] Inventor: Joseph Lin, No. 13-3, Yuh Der Rd., Taichung, Taiwan

[21] Appl. No.: 559,115

[22] Filed: Nov. 16, 1995

[51] Int. Cl.[6] ..... B25C 1/04

[52] U.S. Cl. ..... 227/109; 227/119; 227/120

[58] Field of Search ..... 227/109, 119, 227/120, 135, 136, 127

[56] References Cited

U.S. PATENT DOCUMENTS

| | | | |
|---|---|---|---|
| 4,304,349 | 12/1981 | Novak et al. | 227/109 |
| 4,732,309 | 3/1988 | Judge | 227/109 |
| 4,749,115 | 6/1988 | Fehrs | 227/109 |
| 4,815,647 | 3/1989 | Chou | 227/109 |
| 5,180,091 | 1/1993 | Ota | 227/120 |
| 5,335,800 | 8/1994 | Liu | 227/120 |
| 5,368,213 | 11/1994 | Massarij, Jr. | 227/120 |

*Primary Examiner*—Scott A. Smith
*Attorney, Agent, or Firm*—Browdy and Neimark

[57] ABSTRACT

A nail magazine of nail stapler comprises a main body, a cap, a nail pushing member, an end plate member and a cover plate. The nail magazine is provided with a receiving slot for accommodating the U-shaped nails, a linear slot for accommodating the single-legged nails having a head, and a linear groove for accommodating the single-legged nails without a head. The nail magazine can also accommodate nails of various lengths.

4 Claims, 3 Drawing Sheets

NAIL MAGAZINE OF NAIL STAPLER

FIELD OF THE INVENTION

The present invention relates generally to a nail stapler, and more particularly to an improved nail magazine of the nail stapler.

BACKGROUND OF THE INVENTION

The conventional nail stapler comprises a nail magazine in which only one kind of nails can be kept. As shown in FIG. 1, a prior art nail magazine 10 comprises a body 12 having a cross section of an inverted T-shaped construction for keeping therein the nails having an inverted U shape. The nail magazine 10 further comprises a cap 14 having an inverted U-shaped cross section. An inverted U-shaped slot 13 is formed between the body 12 and the cap 14 for keeping the nails. Such a nail magazine 10 as described above can not be used to keep the nails having a pointed end and a flattened head.

As shown in FIG. 2, a prior art nail magazine 15 comprises a body 16, a cap 18, and a slot 19 formed between the body 16 and the cap 18 for keeping therein the nails having a pointed end and a flattened head.

As shown in FIG. 3, a prior art nail magazine 20 comprises a body 22, a cap 24, and a slot of an inverted U-shaped construction for keeping therein the U-shaped nails of three different sizes. The body 22 has a rib 25 which is provided with a channel 26. There are three inverted U-shaped slots which are of different sizes and are formed between the body 22 and the cap 24 for accommodating the U-shaped nails of three different sizes. Located at both sides of the largest U-shaped slot are two side slots 27 and 28 for accommodating the traditional single-legged nails and the T-shaped nails. This prior art nail magazine 20 has an inherent shortcoming that it can not accommodate the nails having different lengths.

SUMMARY OF THE INVENTION

It is therefore the primary objective of the present invention to provide a nail stapler with an improved nail magazine capable of accommodating the nails of different kinds and lengths.

The foregoing objective and features of the present invention will be more readily understood upon a thoughtful deliberation of the following detailed description of the present invention in conjunction with the accompanying drawings.

DETAILED DESCRIPTION OF THE INVENTION

Figure 1:
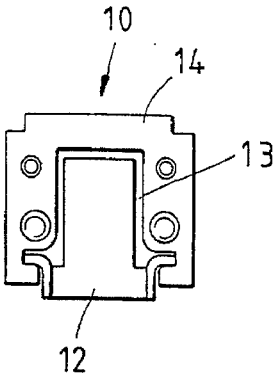
FIG. 1 shows a sectional view of a first prior art nail magazine of the nail stapler.
Figure 2:
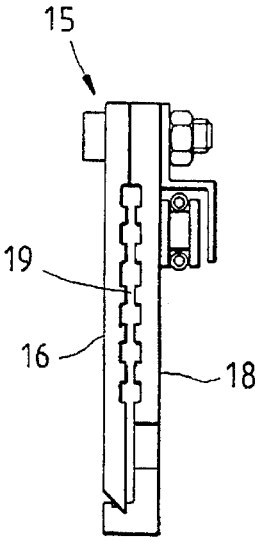
FIG. 2 shows a sectional view of a second prior art nail magazine of the nail stapler.
Figure 3:
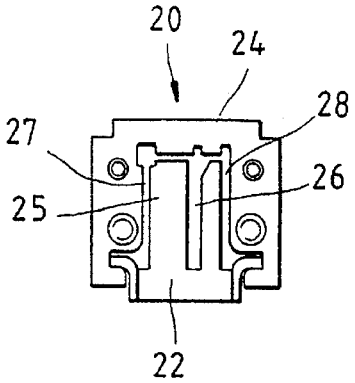
FIG. 3 shows a sectional view of a third prior art nail magazine of the nail stapler.
Figure 5:
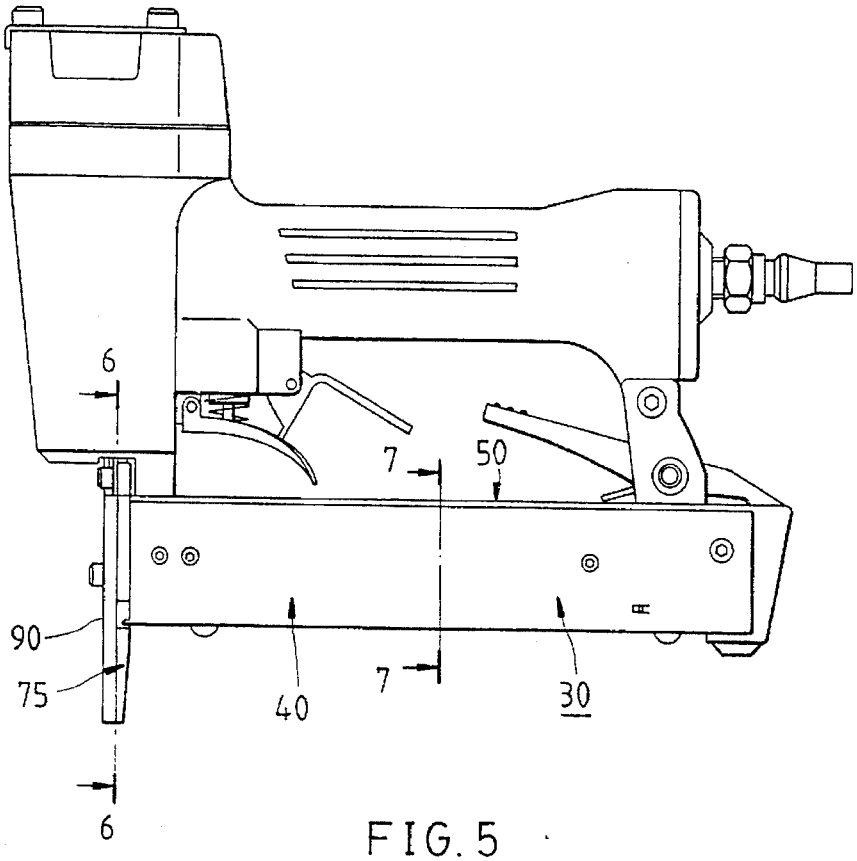
FIG. 5 shows the nail magazine of the present invention in combination with a nail stapler.
Figure 4:
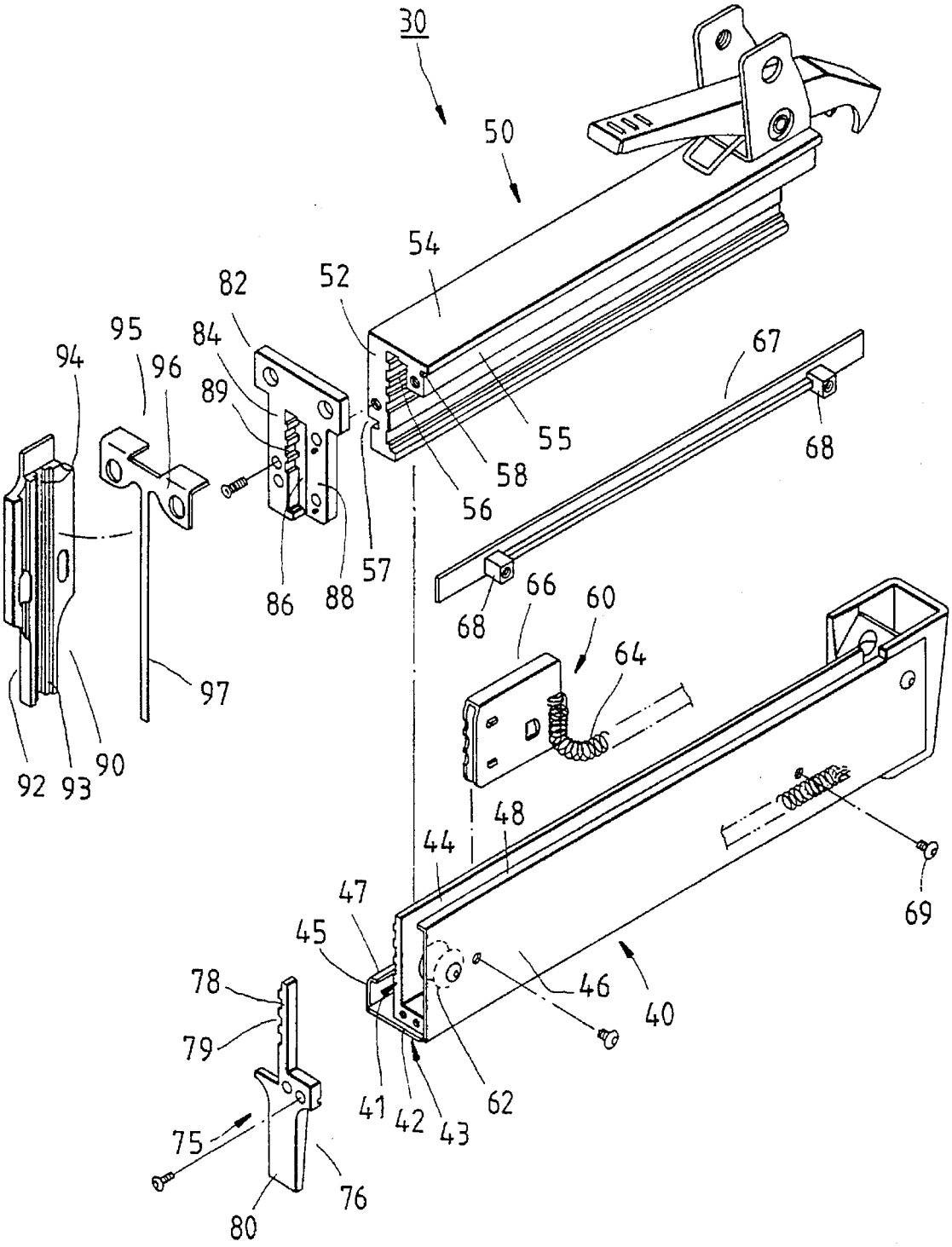
FIG. 4 shows an exploded view of a nail magazine of the present invention.

As shown in FIG. 4, a nail magazine 30 of the present invention for the nail stapler comprises the component parts which are described explicitly hereinafter.

A main body 40 of an elongated construction has a T-shaped cross section and comprises a bottom edge 42 and a rib 44 extending upwardly from the bottom edge 42 which has a right portion thicker than a left portion thereof. The main body 40 further comprises a left piece 45 and a right piece 46, which extend upwardly along the direction of the axis of the main body 40 from left and right sides of the bottom edge 42. The left and the right pieces 45 and 46 are parallel to the rib 44 and are separated by a predetermined interval. The left and the right pieces 45 and 46 are provided respectively at the top thereof with connection portions 47 and 48. The right piece 46 is equal in height to the rib 44. The main body 40 comprises a body 41 of an L-shaped cross section and a piece 43 having a cross section which is a mirror image of the L-shaped cross section. The body 41 is fastened at the bottom thereof with the upper side of the bottom of the piece 43 for forming the bottom edge 42, the rib 44, the left piece 45, and the right piece 46.

A cap 50 of an elongated construction has an inverted L-shaped cross section and comprises an upright body 52 and a horizontal body 54 extending from the top of the upright body 52. The horizontal body 54 is provided with a protruded strip 55 extending along the direction of the axis of the horizontal body 54. A space 56 is formed between the protruded strip 55 and the upright body 52. The cap 50 further comprises an insertion slot 57 extending along the direction of the axis of the cap 50 and along the bottom of one side of the upright body 52. The horizontal body 54 is provided axially with an insertion slot 58.

A nail pushing member 60 comprises a roller 62, a spring 64, and a nail pushing piece 66. The roller 62 is mounted on the main body 40 such that the roller 62 is separated from the rib 42 of the main body by a predetermined distance. The spring 64 is fastened at one end thereof with the right piece 46 such that the spring 64 encircles the roller 62. The nail pushing piece 66 has an inverted U-shaped cross section and is mounted slidably on the rib 44 of the main body 40 such that the nail pushing piece 66 is fastened at one side thereof with one end of the spring 64 and that the nail pushing piece 66 can be pulled by the spring 64 to slide toward the front end of the rib 44.

Figure 7:
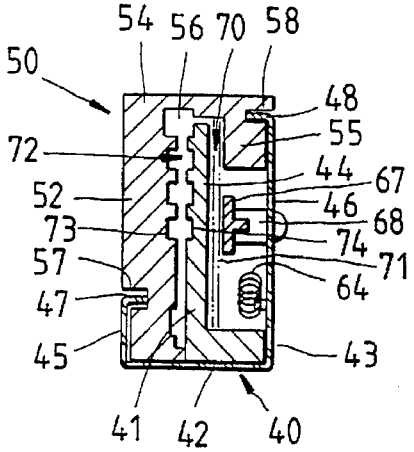
FIG. 7 shows a sectional view of a portion taken in the direction indicated by the line 7—7 as shown in FIG. 5.

In combination, the main body 40 is joined with the cap 50 such that the insertion portions 47 and 48 of the left and the right pieces 45 and 46 of the main body 40 are received in the insertion slots 57 and 58 of the upright body 52 and the horizontal body 54 of the cap 50, and that the rib 44 of the main body 40 is located in the space 56 located between the protruded strip 55 and the upright body 52, without making contact with the periphery of the space 56. As a result, an inverted U-shaped receiving slot 70 is formed by the periphery of the rib 44, the upright body 52, the horizontal body 54, and the protruded strip 55, as shown in FIG. 7. A linear slot 72 is formed between one side of the rib 44 and the upright body 52. The linear slot 72 is provided in the walls of two sides thereof with two grooves 73 and 74, which are opposite to each other and separated from each other by a predetermined distance.

A limiting piece 67 of an elongated construction is provided in one side thereof with two connection portions 68 which are separated from each other by a predetermined interval. The limiting piece 67 is fastened in the main body 40 such that the connection portions 68 are fastened with the inner side of the right piece 46 of the main body 40 by screws 69, and that the limiting piece 67 is parallel to the rib 42, and further that the front end of the limiting piece 67 is located between the rib 42 of the main body 40 and the roller 62 of the nail pushing member 60, and still further that the limiting piece 67 and the rib 42 form therebetween a linear groove 71.

Figure 6:
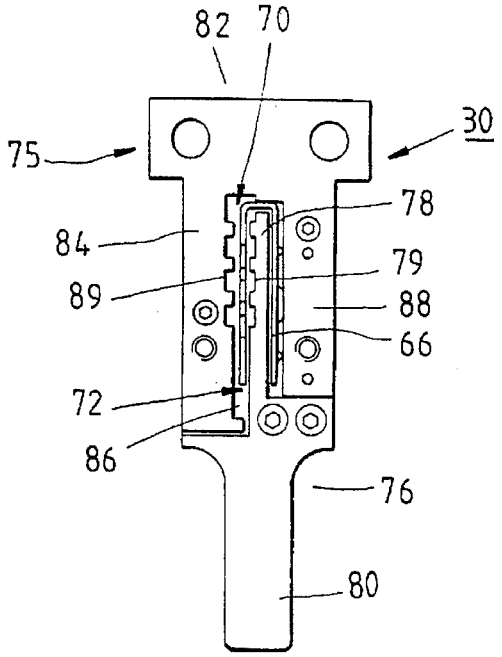
FIG. 6 shows a sectional view of a portion taken in the direction indicated by the line 6—6 as shown in FIG. 5.

Upon completion of assembling the nail magazine 30 of the present invention, an end plate member 75 is fastened with the front end of the nail magazine 30. The end plate member 75 comprises a muzzle plate 76 of a cruciform construction and a face plate 82 of an inverted U-shaped construction. The muzzle plate 76 is fastened with the front end of the bottom of the main body 40 such that the rib 78 of the muzzle plate 76 is corresponding in location to the rib 44 of the main body 40. The rib 78 is provided with a plurality of recesses 79 corresponding in location to the grooves 73 and 74. The muzzle plate 76 has a mouth 80 extending under the nail magazine 30. The face plate 82 has a left body 84, a rectangular hole 86, and a right body 88. The face plate 82 is fastened with the front ends of the upright body 52 and the horizontal body 54 of the cap 50. The left body 84 is provided in the inner side thereof with a recessed portion 89 corresponding in location to the groove 74. The rectangular hole 86 of the face plate 82 is dimensioned to receive therein the rib 78 of the muzzle plate 76. As a result, a receiving slot 70 of an inverted U-shaped construction is formed inside the end plate member 75. As show in FIGS. 6 and 7, the right piece 46 of the main body 40, the roller 62 of the nail pushing member 60, the limiting piece 67, and the protruded strip 55 of the horizontal body 54 of the cap 50 are all concealed by the right body 88 of the face plate 82.

Figure 8:
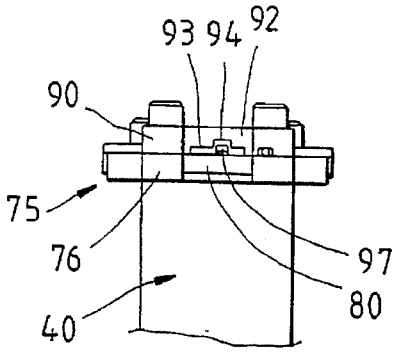
FIG. 8 is a bottom view of FIG. 5 to show the muzzle of the nail stapler.

A cover plate 90 is joined with the end plate member 75. The cover plate 90 has a mouth 92 engageable with the mouth 80 of the muzzle plate 76. Now referring to FIG. 8, the cover plate 90 is provided with a groove 93. A restriction member 95 is disposed between the cover plate 90, the face plate 82, and the muzzle plate 76. The restriction member 95 comprises a body 96 and a resilient portion 97. Upon being exerted on by an external force, the resilient portion 97 is received in a restriction slot 94 located in the groove 93. When the resilient portion 97 is not exerted on by the external force, the resilient portion 97 is kept out of the restriction slot 94, as shown in FIG. 8. The restriction member 95 is a prior art structure and will not be therefore described further.

Figure 10:
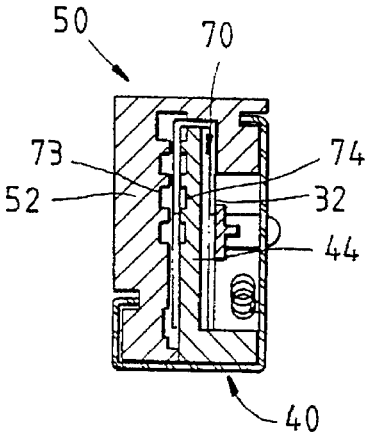
FIG. 10 is a schematic view of the present invention at work to accommodate the U-shaped nails.
Figure 9:
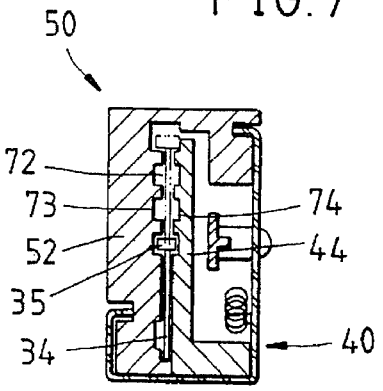
FIG. 9 is a schematic view of the present invention at work to accommodate single-legged nails.

In operation, the U-shaped nails 32 and the single-legged nails 34 having a head 35 are deposited respectively in the receiving slot 70 and the linear slot 72, as indicated by the dotted lines in FIGS. 9 and 10. The single-legged nails 36 without a head are deposited in the linear groove 71, as indicated by the dotted lines in FIG. 7. The nails 32, 34 and 36 are moved by the nail pushing piece 66 of the nail pushing member 60 toward the front end of the nail magazine 30 where the nails are ready to be fired. When the single-legged nails 34 having a head 35 are deposited in the nail magazine 30, the heads 35 of the nails 34 are restrained by the resilient portion 97 of the restriction member 95, as illustrated in FIG. 8. When the single-legged nails 36 without a head are deposited in the linear groove 71, the nails 36 are restrained by the resilient portion 97 of the restriction member 95.

Depending on the length of the single-legged nails 34, the single-legged nails 34 are deposited in the linear slot 72 such that the heads 35 are located in the grooves 73 and 74, as indicated by the solid lines and the dotted lines in FIG. 9. Similarly, the U-shaped nails 32 having different leg lengths are deposited in the U-shaped receiving slot 70, as shown in FIG. 10. The linear groove 71 of the present invention can accommodate the nails 36 of various lengths.

What is claimed is:

1. A nail magazine of a nail stapler, which comprises:

a main body provided with a rib;

a cap fastened with said main body to form therebetween slots for receiving therein nails;

a nail pushing member disposed in a nail magazine and composed of a nail pushing piece, a resilient element and a roller, said nail pushing piece being disposed on said rib of said main body such that said nail pushing piece is urged by said resilient element;

an end plate member fastened at one end of said nail magazine; and a cover plate fastened at said one end of said nail magazine;

wherein said main body has a T-shaped cross section, a bottom with said rib extending from said bottom, said bottom provided axially with a left piece and a right piece which are separated from said rib by a predetermined interval and are provided respectively at a top thereof with a connection portion;

wherein said cap has an inverted L-shaped cross section, an upright body and a horizontal body extending from a top of said upright body, said horizontal body having axially a protruded strip forming a space between said protruded strip and an inner side of said upright body, said upright body and said horizontal body provided respectively with an insertion slot;

wherein said main body and said cap are joined together such that said connection portions of said left piece and said right piece of said main body are engaged with said insertion slots of said upright body and said horizontal body of said cap, and that said rib of said main body is located in said space, and further that said rib, said upright body, said horizontal body and said protruded strip form a receiving slot of an inverted U-shaped construction, and still further that said rib and said upright body form therebetween a linear slot;

wherein said roller of said nail pushing member is fastened pivotally with said right piece of said main body such that said roller is separated from said rib by a predetermined distance; and wherein said linear slot is provided in side walls thereof with a plurality of slots for accommodating nails of various lengths.

2. The nail magazine as defined in claim 1 further comprising a limiting piece fastened to an inner side of said right piece of said main body such that said limiting piece is located under said protruded strip of said cap, and that said limiting piece is parallel to said rib of said main body to form a linear groove with said rib.

3. The nail magazine as defined in claim 1, wherein said main body comprises a body having an L-shaped cross section, and a piece having a cross section which is a mirror image of said L-shaped cross section of said body of said main body, said body being fastened at a bottom thereof with an upper side of a bottom of said piece.

4. The nail magazine as defined in claim 1, wherein said end plate member comprises a cruciform muzzle plate and an inverted U-shaped face plate, said muzzle plate provided at a top edge thereof with a rib and at a bottom edge thereof with a mouth, said muzzle plate fastened with said main body such that said rib of said muzzle plate is corresponding in location to said rib of said main body, said rib of said muzzle plate provided with a plurality of recesses corresponding in location to said grooves of said rib of said main body, said mouth of said muzzle plate located below said nail magazine main body, said face plate having a left body, a rectangular aperture and a right body, said face plate being fastened with said cap such that a recessed portion of said left body of said face plate is corresponding in location to said insertion slot of said upright body of said cap, and that said rectangular aperture of said face plate contains said rib of said muzzle plate, so as to form inside said end plate member an inverted U-shaped gap for ensuring structural integrity of said inverted U-shaped receiving slot and said linear slot.

* * * * *